US006195977B1

(12) United States Patent
Mille

(10) Patent No.: US 6,195,977 B1
(45) Date of Patent: Mar. 6, 2001

(54) WATCHBAND WITH ARTICULATE LINKS

(75) Inventor: Richard Mille, Paris (FR)

(73) Assignee: Malboussin Horlogers, Paris (FR)

( * ) Notice: Subject to any disclaimer, the term of this patent is extended or adjusted under 35 U.S.C. 154(b) by 0 days.

(21) Appl. No.: 09/194,718

(22) PCT Filed: Apr. 20, 1998

(86) PCT No.: PCT/IB98/00574

§ 371 Date: Dec. 17, 1998

§ 102(e) Date: Dec. 17, 1998

(87) PCT Pub. No.: WO98/48657

PCT Pub. Date: Nov. 5, 1998

(30) Foreign Application Priority Data

Apr. 25, 1997 (CH) ..... 0968/97

(51) Int. Cl.[7] ..... F16G 13/00; F16G 15/14
(52) U.S. Cl. ..... 59/80; 59/78; 59/82; 59/91
(58) Field of Search ..... 59/78, 80, 82, 59/91

(56) References Cited

U.S. PATENT DOCUMENTS 1,519,578 * 12/1924 Fielding et al. ..... 59/80
1,554,095 * 9/1925 Hultman ..... 59/80
1,626,139 * 4/1927 Kraysler ..... 59/80
1,669,710 * 5/1928 Jones ..... 59/80
1,738,407 * 12/1929 Tost ..... 59/80
1,750,786 * 3/1930 Roy ..... 59/80
1,753,971 * 4/1930 Roy ..... 59/80
1,767,529 * 6/1930 Jones ..... 59/80
1,779,383 * 10/1930 Spatschil ..... 59/80
1,784,451 * 12/1930 Kramer ..... 59/80

FOREIGN PATENT DOCUMENTS

646850 A5 * 12/1984 (CH) .
0339123 A1 * 11/1989 (EP) .
0576998 A1 * 1/1994 (EP) .

* cited by examiner

*Primary Examiner*—David Jones
(74) *Attorney, Agent, or Firm*—John D. Titus

(57) ABSTRACT

The watchband or jewelry bracelet with articulated links and flexible fittings comprises links (1, 2, 3, 4) articulated with each other. Each link comprises a lower part (6), side walls and upper shoulders (5) constituting a receptacle (7) in which a flexible fitting is to be mounted. At one end of each link, the side walls have a convex semicircular portion (11), and at the other end, they have a concave semicircular portion (10). At said other end, rings (8) having a thread (9) are mounted on the lower part (6) of the link and in the receptacle (7). The links are assembled together by screws (15, 16) cooperating with threads of the rings. The concave and convex semicircular portions are intended to cooperate with each other in this assembly position.

14 Claims, 6 Drawing Sheets

WATCHBAND WITH ARTICULATE LINKS

This invention relates to a watchband or jewelry bracelet with articulated links and flexible fittings, in particular to a bracelet comprising links comprising a receptacle in which a flexible fitting is to be mounted, the links being articulated with each other according to an axis situated at the place of connection between the links.

Most watchbands are realized either in flexible material, for example leather or plastic, or with links of ferrous or nonferrous metals articulated with each other.

Versions of combined bracelets are known with bracelets comprising a metallic structure in which a flexible fitting is mounted, made of leather for example. These known versions make it possible to obtain a different esthetic appearance through the combination of two different materials, such as leather and gold for example, and also to obtain a longer life for the flexible fitting which is in part protected from wear by the metallic structure.

The basic principle of a bracelet comprising a metallic structure combined with a flexible fitting is known from the patent GB 230986 from 1925. This known version has an important disadvantage due to the fact that the metallic structure is realized in one piece which, in the case of a watchband, does not permit good adjustment of the bracelet on the wrist.

Another version of a bracelet with a metallic structure combined with a flexible fitting is known from the patent EP 0 339 123 showing links articulated with each other. This version has an important disadvantage due to the fact that the links are joined together by elements mounted on axes which are not situated at the place of connection between the links. This way of fixing the links, also known from the patent CH 675669, has the disadvantage of requiring play between the links. Since the play is very visible it can considerably impair the general esthetics of the bracelet. Furthermore, with these known versions the mounting of the links with each other requires rather complicated and thus expensive operations.

The aim of the present invention is therefore to remedy the aforementioned disadvantages of known versions.

This aim is reached with the principles of the invention as defined by claim 1.

According to the principles of the invention, the watchband or jewelry bracelet with articulated links and flexible fittings comprises links having, in cross section, a horizontal lower part, side walls and horizontal upper shoulders. In this cross section, the link has a rectangular tube shape whose upper part comprises an opening formed on part of the width of the link and over the entire length thereof. A receptacle is thus constituted in which a flexible fitting, made of leather for example, can be mounted and held. At one end of the link, and in a side view, the side walls of the link comprise a convex semicircular portion and upper and lower straight portions. A screw hole and a screw head countersink are formed in the side walls at the center of the radius of the convex semicircular part, the straight portions being disposed in the axis of the center of the radius and the center of the hole. The other end of the walls of the link comprises a concave semicircular portion and upper and lower straight portions, the lower straight portion being set back in relation to the axis of the center of the radius of the concave semicircular portion. Rings comprising a threaded hole are mounted on the lower part of the link at the end where the side walls have the concave portion. The rings are mounted so that the center of each ring corresponds to the center of the radius of the concave portion. Widthwise, the rings are mounted so that the outside surface of each ring is located on the width, with play, of the inside surfaces of the vertical walls of the link. When the links are mounted, the convex portion of a link is intended to cooperate with the concave portion of another link and screws are mounted in through holes and screwed into the rings. In a side view the links have a radius which, when the links are assembled together, give the bracelet a radius corresponding to the radius of the wrist. The straight upper portions of the ends of each link are intended to be in contact with each other when the bracelet is worm. According to the principles of the invention, an important advantage consists in the fact that, during wearing, the links have no spaces or play between them, or very small spaces or play depending on the circumstances, which permits a very good esthetic appearance to be obtained. In fact, the articulation of the links according to an axis disposed in the axis of the straight upper portions ensures that spaces or play between links is practically invisible, in accordance with the small thickness of the links. In extreme cases, for example with bracelets for men having very thick wrists or for women having very small wrists, models of links with different radii can be obtained by manufacture. Another important advantage of the principles of the invention is the considerably simplified mounting of the links.

The attached drawings illustrate the principles of the invention schematically and by way of example.

Figure 1:
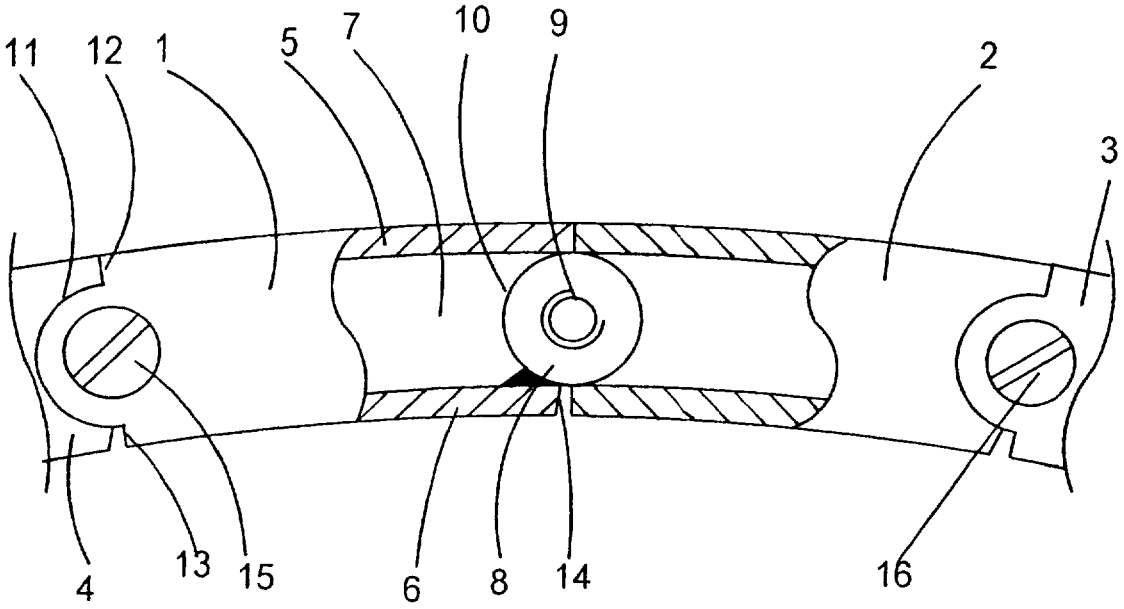
FIG. 1 is a partial cutaway side view of links assembled together.
Figure 2:
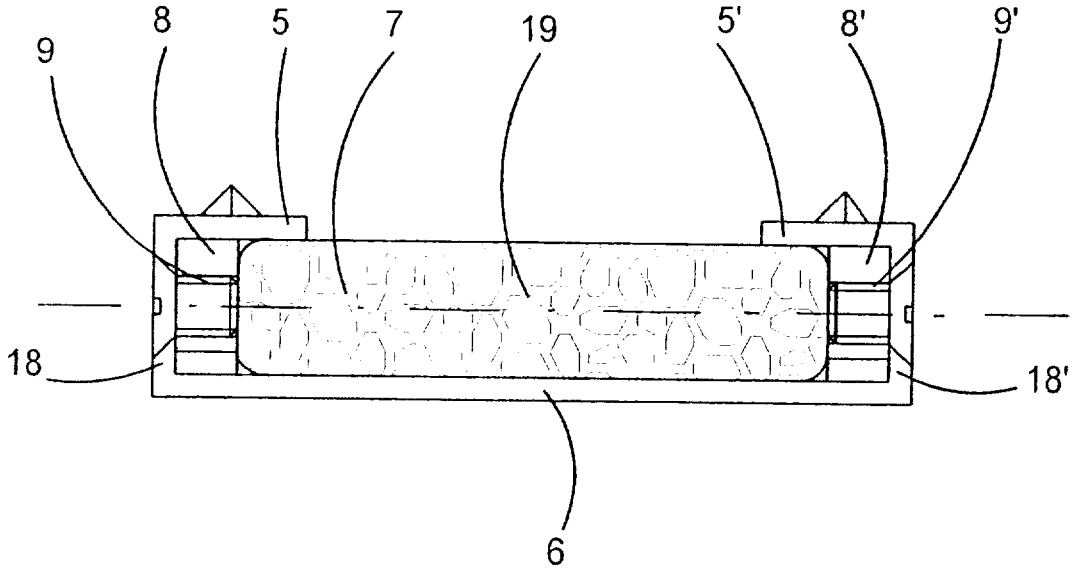
FIG. 2 is a cross-sectional view of links in the assembly position.
Figure 3:
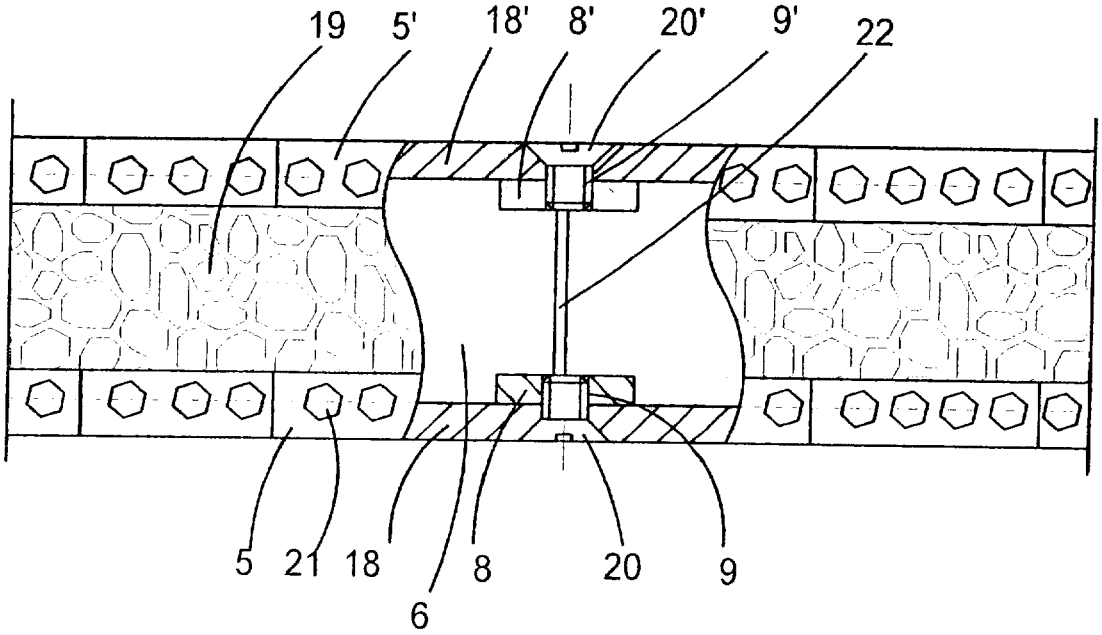
FIG. 3 is a partial cutaway top view of links assembled together.

Referring first to FIGS. 1, 2 and 3, links 1, 2, 3 and 4 constituting part of the bracelet are assembled together. Each link comprises lower part 6, side walls 18 and 18' and upper shoulders 5 and 5'. Receptacle 7 is thus constituted in which flexible fitting 19, made of leather for example, can be mounted. At one end of each link, the side walls comprise convex semicircular portion 11 and upper and lower straight portions 12, 13. At the other end, the side walls of each link comprise concave semicircular portion 10 intended to cooperate with the convex semicircular portion of the other link. At said other end, the side walls comprise upper and lower straight portions. Lower portion 14 is set back so as to have play when the links are assembled. At said other end, rings 8 and 8' are mounted on lower part 6 of the link. Rings 8 and 8' comprise threads 9 and 9'. The rings can be fixed on lower part 6 of the link by soldering for example. The links are assembled together by screws 15, 16, 20, 20'. The rings and the center of the radii of the convex and concave semicircular portions are disposed on the same axis of rotation. The upper and lower straight portions are also aligned in relation to said axis of rotation, with the exception of lower straight portion 14 which is set back in relation to said axis so that there is play between the lower straight portions of each link when they are assembled. The lower parts of each link are also designed so as to have space 22 when the links are assembled. As shown in a side view in FIG. 1, the links have a radius, the radius being intended to give the bracelet a radius corresponding to the wrist of the bracelet wearer. When the bracelet is worn, the upper straight portions of each link are intended to be in contact with each other so that the visible part of the bracelet has a continuous appearance without spaces between the links. If wrist dimensions are different and the differences are not too great, a small space between links can appear, but in accordance with the position of the axes of rotation which are disposed at the place of connection between links and in accordance with the distribution over all links, these spaces are difficult to see and cannot impair the esthetic advantage resulting from the continuity of the bracelet links. If there are very great differences in wrist dimensions, for men or for women for example, bracelets with links of different radii can be provided. The upper shoulders can comprise diamonds 21 or other decorations.

Figure 4:
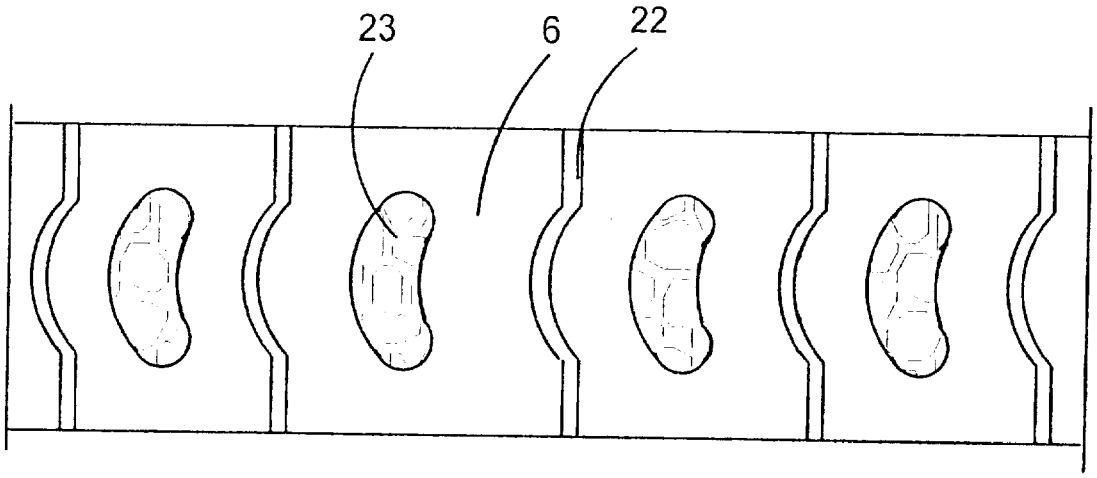
FIG. 4 is a bottom view of links assembled together.

FIG. 4 shows a bottom view of the bracelet with assembled links showing space 22 between the lower parts, for example lower part 6. The lower part of each link can comprise opening 23 whose purpose is, on the one hand, esthetic and, on the other hand, to make the bracelet lighter and also reduce material costs, which can be important when the links are realized in noble materials, for example gold.

Figure 5:
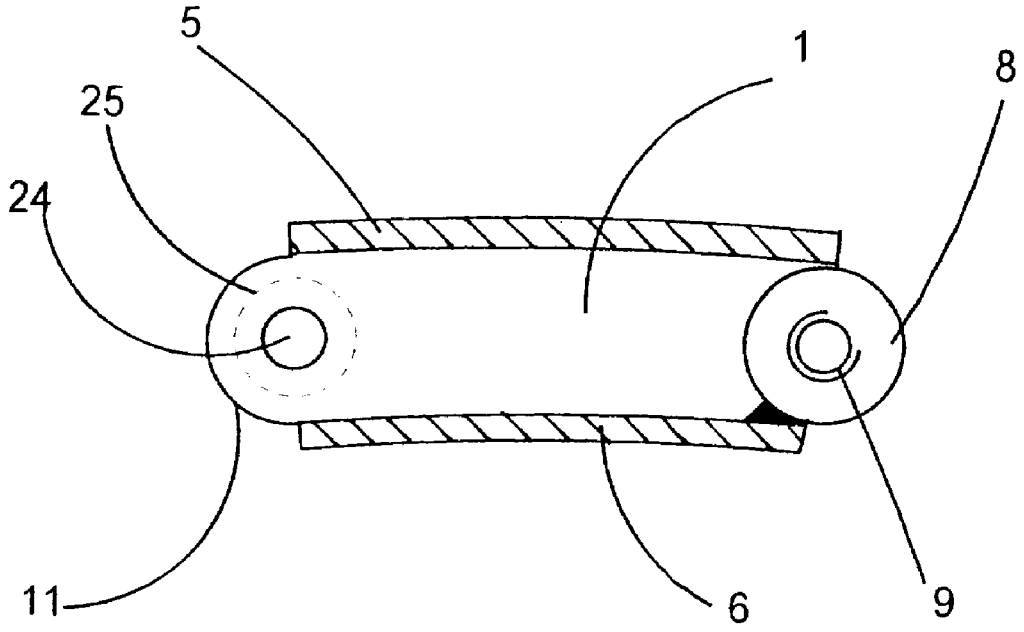
FIG. 5 is a cutaway side view of a detail of a link.
Figure 6:
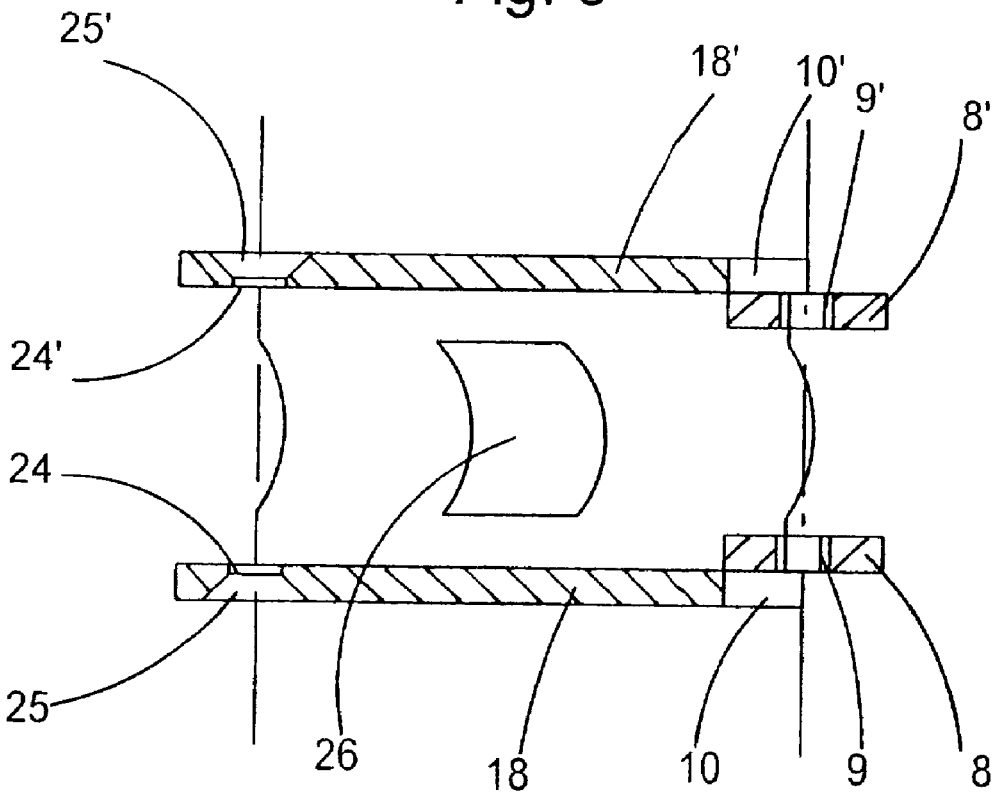
FIG. 6 is a cutaway top view of a detail of a link.

FIGS. 5 and 6 show detail views of link 1 comprising upper shoulders 5, lower part 6 and of walls lateral 18 and 18'. At one end of the link, the side walls comprise convex semicircular portion 11. At this end, the side walls comprise screw holes 24 and 24' and screw head countersinks 25 and 25'. At the other end, the side walls of the link comprise of concave semicircular portions 10 and 10' and rings 8 and 8' comprising threads 9 and 9' and fixed on lower part 6. Widthwise, the rings are disposed so that the outside surface of each ring is disposed, with play, on the width of the inside surface of each side wall.

Lower part 6 can comprise opening 26.

Figure 7:
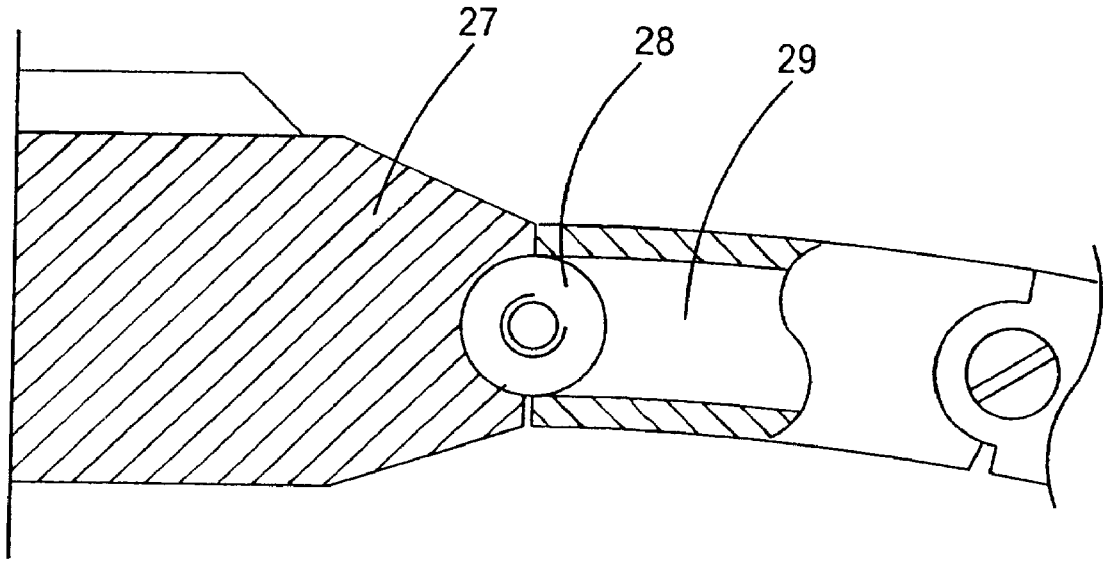
FIG. 7 is a cutaway side view of the assembly of one end of the bracelet with a watch case.

FIG. 7 shows the assembly of one of the ends of the bracelet with watch case 27. Rings 28 are mounted on the watch case and intended to cooperate with link 29.

Figure 8:
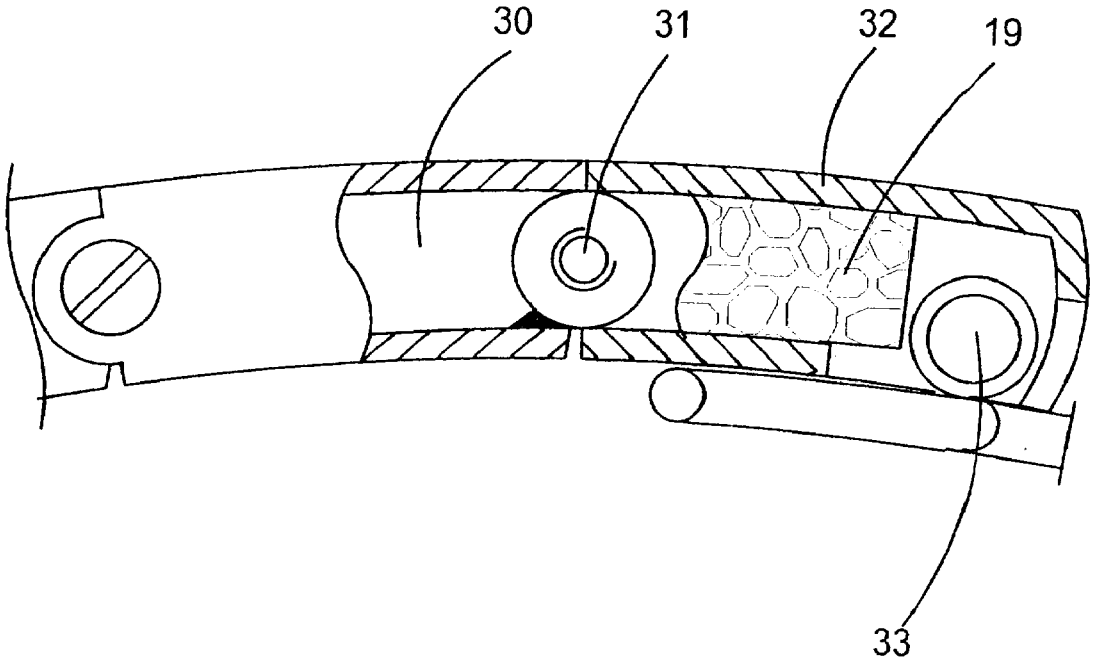
FIG. 8 is a cutaway side view of the assembly of one end of the bracelet with a clasp.
Figure 9:
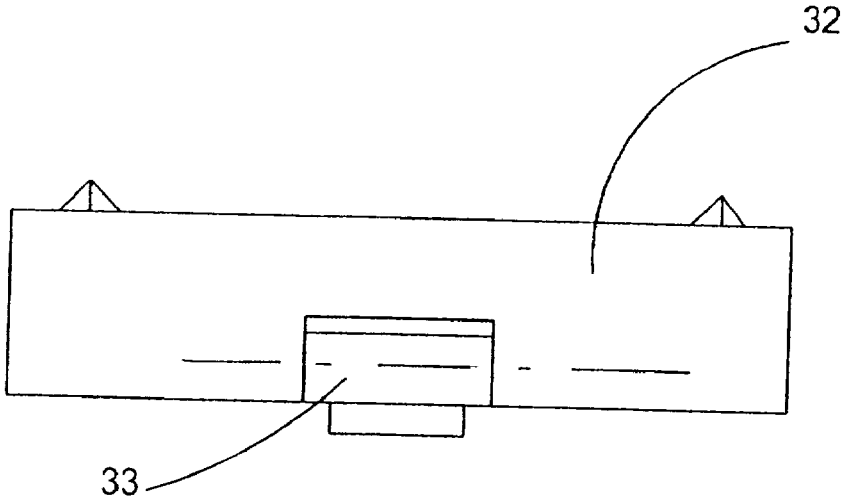
FIG. 9 is a front view of one end of the bracelet and the clasp.

FIGS. 8 and 9 show an end of the bracelet comprising a clasp. Last link 30 of one of the bracelet elements is joined to end element 32 by screws 31. The end element is joined to clasp 33. In practice, when the links of the bracelet are assembled together and when the thus constituted bracelet element is assembled with the watch case, flexible fitting 19 is introduced into the bracelet and cut in length taking account of the length of the end element. The end element is then mounted and fixed by screws 31 to link 30. The flexible fitting is thus blocked longitudinally by the end element. This design also permits easy replacement of flexible fittings. In case the user wishes to change the nature or color of the flexible fitting, it is sufficient to disassemble the end element, withdraw the existing flexible fitting and replace it by another flexible fitting, reassembling the end element.

Figure 10:
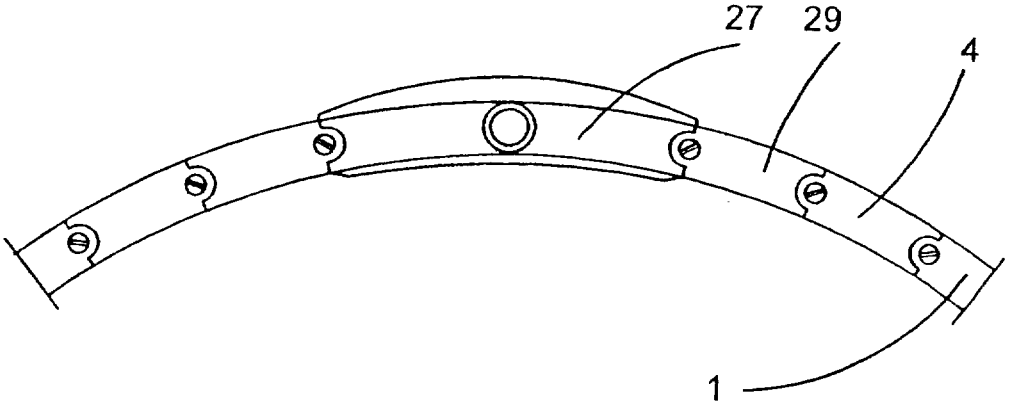
FIGS. 10 and 11 are side and top views, respectively, of a bracelet assembled with a watch case.
Figure 11:
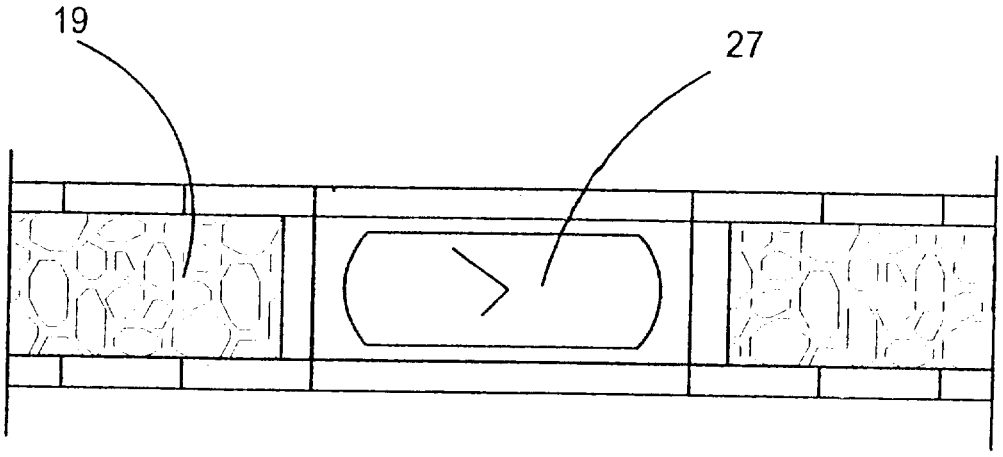

FIGS. 10 and 11 show general views of a bracelet constituted by links 1, 4, 29 which is joined to watch case 27, the bracelet being constituted by links comprising flexible fittings 19.

The links can be realized with various materials, ferrous or nonferrous metals, and noble materials, for example gold.

The flexible fittings can be made of leather, crocodile, or any kind of natural or synthetic flexible material.

What is claimed is:

1. A bracelet with articulated links and flexible fittings comprising links each comprising a lower part, side walls and upper shoulders constituting a receptacle in which a flexible fitting is to be mounted, characterized in that at a first end of each link the side walls each have a convex semicircular portion and upper and lower straight portions, and at a second end of each link, rings having threads each defining a longitudinal axis are mounted on the lower part, the side walls having at the second end a concave semicircular portion and upper and lower straight portions, and when the links are assembled the convex and concave semicircular side wall portions are intended to cooperate with each other, the links being joined together by screws each having a longitudinal axis, the screws engaging the threads of the rings, the longitudinal axis of the screws and rings being aligned with the axis determined by the center of the radii of the concave and convex semicircular portions.

2. The bracelet according to claim 1, characterized in that the upper straight portions of the side walls are intended to cooperate with each other, and said upper straight portions are disposed in alignment with the axis of the screws and the axis determined by the center of the radii of the concave and convex semicircular portions.

3. The bracelet according to claim 1, characterized in that one of the lower straight portions is misaligned with the upper straight portions of the side walls so that when the links are assembled the lower straight portions are separated by a space.

4. The bracelet according to claim 1, characterized in that the rings comprise outside surfaces, said side walls comprise inside surfaces, said rings being disposed so that the outside surfaces of the rings are in substantially planar alignment with the inside surfaces of the side walls.

5. The bracelet according to claim 1, further comprising a watch case, said bracelet characterized in that rings are mounted on the watch case, and the rings are intended to cooperate with a link mounted at one end of the bracelet.

6. The bracelet according to claim 1, further comprising a clasp, said bracelet characterized in that an end element is joined to a link mounted at one end of the bracelet, and the end element, which is joined to said clasp, permits the flexible fitting to be blocked longitudinally.

7. The bracelet according to claim 1, characterized in that at the end of the link comprising the convex semicircular portions the side walls comprise screw holes and screw head countersinks.

8. A bracelet comprising:

a plurality of links having a first link end and a second link end, each of said plurality of links comprising a lower part, first and second side walls and first and second upper shoulders;

each of said first and second side walls comprising a first end proximal said first link end, said first end comprising a convex semicircular portion and a first end upper and first end lower straight portion each disposed proximal said convex semicircular portion;

each of said first and second side walls comprising a second end proximal said second link end, said second end comprising a concave semicircular portion and a second end upper and second end lower straight portion each disposed proximal said concave semicircular portion;

each of said concave portions adapted to receive one of said convex portions;

said lower part, side walls and upper shoulders of each said link bounding a receptacle;

a flexible fitting mounted within said receptacle;

a plurality of first rings mounted on said lower part at said second link end, each of said plurality of first rings having an axis of rotation, each of said plurality of first rings having a thread disposed therethrough concentric with a center of radii determined by said concave and convex semicircular portions, said thread adapted to receive a screw therethrough such that when said links are assembled, an axis through the screw and said ring axis coincide with an axis determined by the center of the radii of said concave and convex semicircular portions.

9. The bracelet according to claim 8, wherein said first end upper straight portions cooperate with said second end upper straight portions, and said upper straight portions are disposed in alignment with the axis determined by the center of the radii of said concave and convex semicircular portions.

10. The bracelet according to claim 8, wherein each said second end lower straight portion is misaligned with each said second end upper straight portion such that when said links are assembled, each said first end lower straight portion is separated by a space from each said second end lower straight portion.

11. The bracelet according to claim 8, wherein said first rings comprise outside surfaces, said side walls comprise inside surfaces, said outside surfaces of said first rings being in substantially planar alignment with said inside surfaces of said side walls.

12. The bracelet according to claim 8, further comprising a watch case, said bracelet further comprising second rings mounted on said watch case, said second rings cooperating with a link mounted at a first end of said bracelet.

13. The bracelet according to claim 8, further comprising a clasp, said bracelet characterized in that an end element is joined to a link mounted at one end of the bracelet, and the end element, which is joined to said clasp, permits the flexible fitting to be blocked longitudinally.

14. The bracelet according to claim 8, wherein said first and second side walls comprise screw holes and screw head countersinks.

* * * * *